US007576495B2

(12) United States Patent
Hong et al.

(10) Patent No.: US 7,576,495 B2
(45) **Date of Patent: *Aug. 18, 2009**

(54) PLASMA DISPLAY PANEL

(75) Inventors: Sang Min Hong, Seoul (KR); Sang Kook Lee, Gumi-si (KR); Han Ick Oh, Daegu-si (KR); Ki Eon Eom, Daejeon (KR); Jin Han Lee, Hwaseong-si (KR)

(73) Assignee: LG Electronics Inc., Seoul (KR)

( * ) Notice: Subject to any disclaimer, the term of this patent is extended or adjusted under 35 U.S.C. 154(b) by 20 days.

This patent is subject to a terminal disclaimer.

(21) Appl. No.: 11/623,793

(22) Filed: Jan. 17, 2007

(65) Prior Publication Data

US 2008/0042576 A1 Feb. 21, 2008

(30) Foreign Application Priority Data

Aug. 21, 2006 (KR) ..... 10-2006-0079051

(51) Int. Cl.
*G09G 3/10* (2006.01)
*H01J 17/49* (2006.01)

(52) U.S. Cl. ..... 315/169.1; 313/581; 313/584; 313/495

(58) Field of Classification Search ..... 315/169.1, 315/169.4; 313/582–586, 494–498, 581, 313/593; 345/60, 62, 63, 67, 77
See application file for complete search history.

(56) References Cited

U.S. PATENT DOCUMENTS 6,522,072 B1 * 2/2003 Yura et al. ..... 313/582
6,583,560 B1 * 6/2003 Amemiya ..... 313/586
6,683,589 B2 * 1/2004 Sano et al. ..... 345/60
7,132,795 B2 * 11/2006 Kim et al. ..... 313/584
7,166,960 B2 * 1/2007 Kim et al. ..... 313/582
2003/0146713 A1 8/2003 Nagao et al.
2004/0183440 A1 9/2004 Huang et al.
2006/0028138 A1 2/2006 Kang
2006/0076877 A1 4/2006 Kim
2008/0030136 A1 * 2/2008 Bae et al. ..... 313/584
2008/0042564 A1 * 2/2008 Hong et al. ..... 313/567

FOREIGN PATENT DOCUMENTS

EP 1 890 313 2/2008
WO 2005/043577 5/2005

OTHER PUBLICATIONS

European Search Report from Application No. 07000257.1 dated Dec. 9, 2008. (9 pages).

* cited by examiner

*Primary Examiner*—Douglas W Owens
*Assistant Examiner*—Jimmy T Vu
(74) *Attorney, Agent, or Firm*—Fish & Richardson P.C.

(57) ABSTRACT

A plasma display panel is disclosed. The plasma display panel includes a front substrate including a first electrode and a second electrode, a rear substrate including a third electrode, and a barrier rib formed between the front and rear substrates. At least one of the first electrode or the second electrode is formed in the form of a single layer. At least one of the first electrode or the second electrode includes at least one line portion intersecting the third electrode, and a plurality of projecting portions projecting from at least one line portion. The shape of at least one of the plurality of projecting portions is different from the shape of the other projecting portions.

20 Claims, 15 Drawing Sheets

PLASMA DISPLAY PANEL

This Nonprovisional application claims priority under 35 U.S.C. § 119(a) on Patent Application No. 10-2006-0079051 filed in Korea on Aug. 21, 2006 the entire contents of which are hereby incorporated by reference.

BACKGROUND

1. Field

This document relates to a plasma display panel.

2. Description of the Background Art

A plasma display panel includes a phosphor layer inside discharge cells partitioned by barrier ribs and a plurality of electrodes.

A driving signal is supplied to the discharge cells through the electrodes, thereby generating a discharge inside the discharge cells.

When the driving signal generates the discharge inside the discharge cells, a discharge gas filled in the discharge cells generates vacuum ultraviolet rays, which thereby cause phosphors formed inside the discharge cells to emit light, thus displaying an image on the screen of the plasma display panel.

SUMMARY

In one aspect, a plasma display panel comprises a front substrate on which a first electrode and a second electrode are formed in parallel to each other, a rear substrate on which a third electrode is formed to intersect the first electrode and the second electrode, and a barrier rib, formed between the front and rear substrates, partitioning a discharge cell, wherein at least one of the first electrode or the second electrode is formed in the form of a single layer, wherein at least one of the first electrode or the second electrode includes at least one line portion intersecting the third electrode, and a plurality of projecting portions projecting from at least one line portion, wherein the shape of at least one of the plurality of projecting portions is different from the shape of the other projecting portions.

In another aspect, a plasma display panel comprises a front substrate on which a first electrode and a second electrode are formed in parallel to each other, a rear substrate on which a third electrode is formed to intersect the first electrode and the second electrode, and a barrier rib, formed between the front and rear substrates, partitioning a discharge cell, wherein at least one of the first electrode or the second electrode is formed in the form of a single layer, wherein at least one of the first electrode or the second electrode includes at least one line portion intersecting the third electrode, and a plurality of projecting portions projecting from at least one line portion, wherein the length of at least one of the plurality of projecting portions is different from the length of the other projecting portions.

In still another aspect, a plasma display panel, comprises a front substrate on which a first electrode and a second electrode are formed in parallel to each other, a rear substrate on which a third electrode is formed to intersect the first electrode and the second electrode, and a barrier rib, formed between the front and rear substrates, partitioning a discharge cell, wherein at least one of the first electrode or the second electrode is formed in the form of a single layer, wherein at least one of the first electrode or the second electrode includes at least one line portion intersecting the third electrode, and a plurality of projecting portions projecting from at least one line portion, wherein the shape of at least one of the plurality of projecting portions is different from the shape of the other projecting portions, wherein an aperture ratio in an active area ranges from 25% to 45%.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

FIGS. 1*a* to 1*d* illustrate one example of a structure of a plasma display panel according to one embodiment.

Figure 1A:
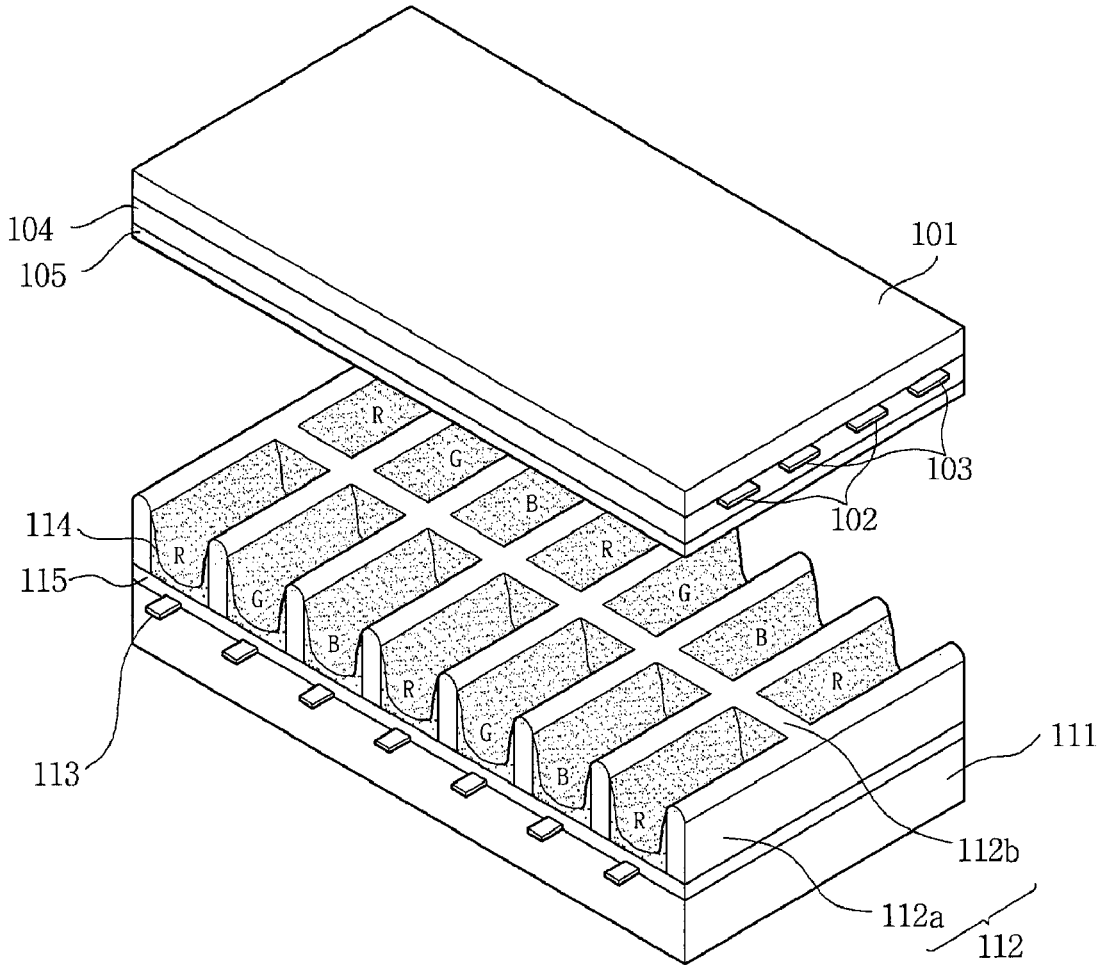
FIGS. 1*a* to 1*d* illustrate one example of a structure of a plasma display panel according to one embodiment.

Referring to FIG. 1*a*, the plasma display panel according to one embodiment includes a front substrate 101 and a rear substrate 111 which are coalesced with each other. On the front substrate 101, a first electrode 102 and a second electrode 103 are formed in parallel to each other. On the rear substrate 111, a third electrode 113 is formed to intersect the first electrode 102 and the second electrode 103.

At least one of the first electrode 102 or the second electrode 103 is formed in the form of a single layer. For example, at least one of the first electrode 102 or the second electrode 103 may be a non-transparent electrode (i.e., an ITO (indium-tin-oxide)-less electrode).

At least one of the first electrode 102 or the second electrode 103 includes an opaque metal with excellent electrical conductivity. Examples of the opaque metal with excellent electrical conductivity include silver (Ag), copper (Cu), and aluminum (Al) that are cheaper than ITO. As a result, a color of at least one of the first electrode 102 or the second electrode 103 may be darker than a color of an upper dielectric layer 104, which will be described later.

The first electrode 102 and the second electrode 103, that may be formed in the form of a single layer, will be described in detail later.

The first electrode 102 and the second electrode 103 generate a discharge inside discharge spaces (i.e., discharge cells), and maintain the discharges of the discharge cells.

The upper dielectric layer 104 for covering the first electrode 102 and the second electrode 103 is formed on an upper portion of the front substrate 101 on which the first electrode 102 and the second electrode 103 are formed.

The upper dielectric layer 104 limits discharge currents of the first electrode 102 and the second electrode 103, and provides insulation between the first electrode 102 and the second electrode 103.

A protective layer 105 is formed on an upper surface of the upper dielectric layer 104 to facilitate discharge conditions. The protective layer 105 includes a material having a high secondary electron emission coefficient, for example, magnesium oxide (MgO).

A lower dielectric layer 115 for covering the third electrode 113 is formed on an upper portion of the rear substrate 111 on which the third electrode 113 is formed. The lower dielectric layer 115 provides insulation of the third electrode 113.

Barrier ribs 112 of a stripe type, a well type, a delta type, a honeycomb type, and the like, are formed on an upper portion of the lower dielectric layer 115 to partition discharge spaces (i.e., discharge cells). A red (R) discharge cell, a green (G) discharge cell, and a blue (B) discharge cell, and the like, are formed between the front substrate 101 and the rear substrate 111.

In addition to the red (R), green (G), and blue (B) discharge cells, a white (W) discharge cell or a yellow (Y) discharge cell may be further formed between the front substrate 101 and the rear substrate 111.

The widths of the red (R), green (G), and blue (B) discharge cells may be substantially equal to one another. Further, the width of at least one of the red (R), green (G), or blue (B) discharge cells may be different from the widths of the other discharge cells.

Figure 1B:
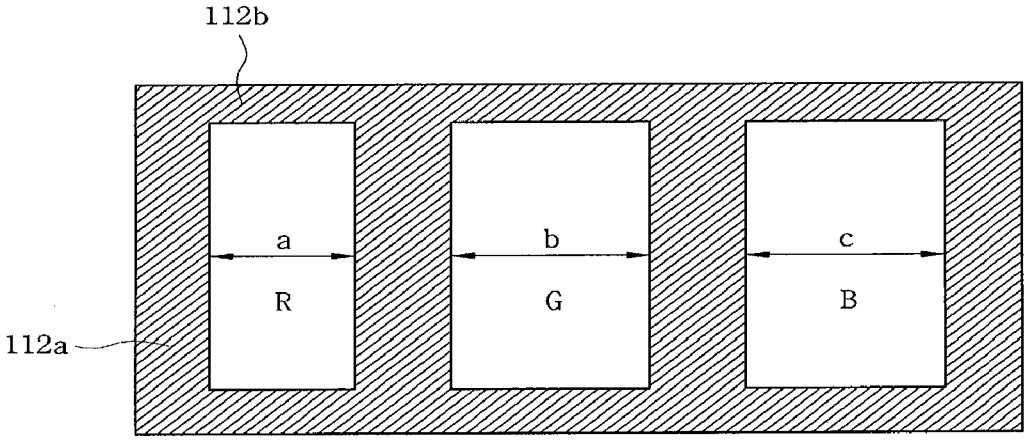

For instance, as illustrated in FIG. 1*b*, a width (a) of the red (R) discharge cell is the smallest, and widths (b and c) of the green (G) and blue (B) discharge cells are more than the width (a) of the red (R) discharge cell. The width (b) of the green (G) discharge cell may be substantially equal to or different from the width (c) of the blue (B) discharge cell.

The widths of the above-described discharge cells determine the width of a phosphor layer 114 formed inside the discharge cells, which will be described later. For example, in a case of FIG. 1*b*, the width of a blue (B) phosphor layer formed inside the blue (B) discharge cell is more than the width of a red (R) phosphor layer formed inside the red (R) discharge cell. Further, the width of a green (G) phosphor layer formed inside the green (G) discharge cell is more than the width of a red (R) phosphor layer formed inside the red (R) discharge cell. As a result, a color temperature of an image displayed on the plasma display panel is improved.

The plasma display panel according one embodiment may have various forms of barrier rib structures as well as a structure of the barrier rib 112 illustrated in FIG. 1*a*. For instance, the barrier rib 112 may include a first barrier rib 112*b* and a second barrier rib 112*a*. The barrier rib 112 may have a differential type barrier rib structure in which the height of the first barrier rib 112*b* and the height of the second barrier rib 112*a* are different from each other, a channel type barrier rib structure in which a channel usable as an exhaust path is formed on at least one of the first barrier rib 112*b* or the second barrier rib 112*a*, a hollow type barrier rib structure in which a hollow is formed on at least one of the first barrier rib 112*b* or the second barrier rib 112*a*, and the like.

Figure 1C:
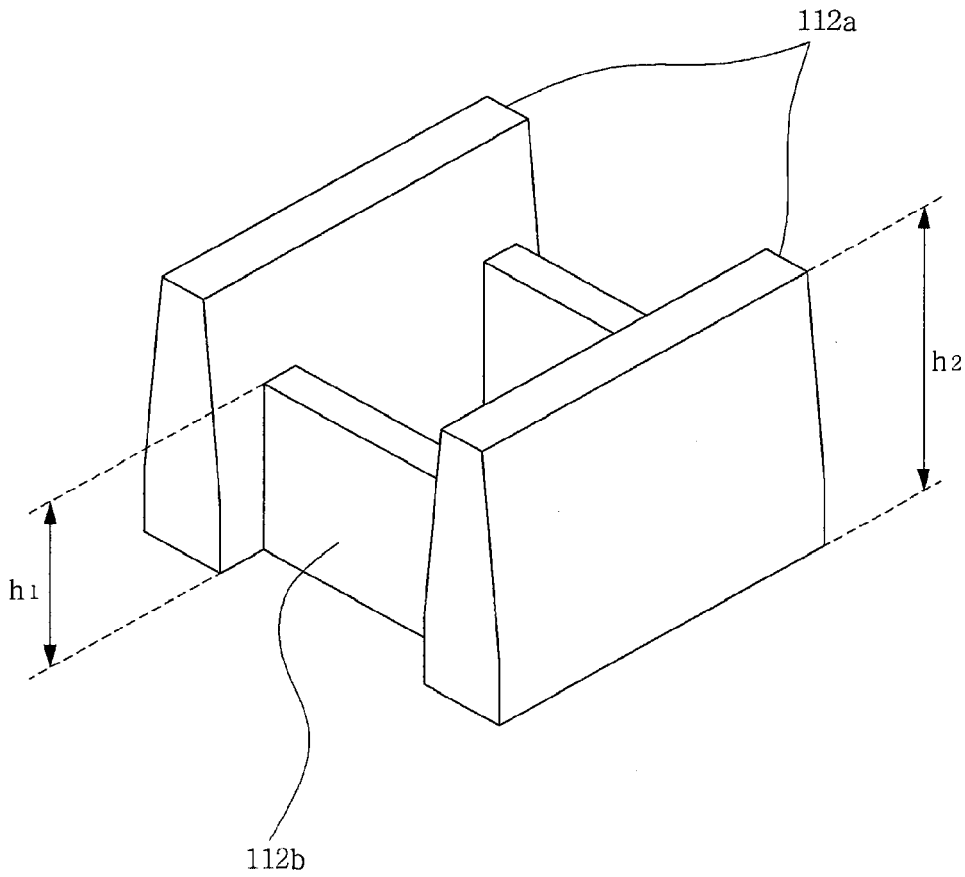

In the differential type barrier rib structure, as illustrated in FIG. 1*c*, a height h1 of the first barrier rib 112*b* is less than a height h2 of the second barrier rib 112*a*. Further, in the channel type barrier rib structure or the hollow type barrier rib structure, a channel or a hollow may be formed on the first barrier rib 112*b*.

While the plasma display panel according to one embodiment has been illustrated and described to have the red (R), green (G), and blue (B) discharge cells arranged on the same line, it is possible to arrange them in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1*a* has illustrated and described a case where the barrier rib 112 is formed on the rear substrate 111, the barrier rib 112 may be formed on at least one of the front substrate 101 or the rear substrate 111.

Each of the discharge cells partitioned by the barrier ribs 112 is filled with a predetermined discharge gas.

A pressure inside the plasma display panel filled with the predetermined discharge gas may range from about 350 torr to 500 torr.

The phosphor layers 114 for emitting visible light for an image display when generating an address discharge are formed inside the discharge cells partitioned by the barrier ribs 112. For instance, red (R), green (G) and blue (B) phosphor layers may be formed inside the discharge cells.

A white (W) phosphor layer and/or a yellow (Y) phosphor layer may be further formed in addition to the red (R), green (G) and blue (B) phosphor layers.

Figure 1D:
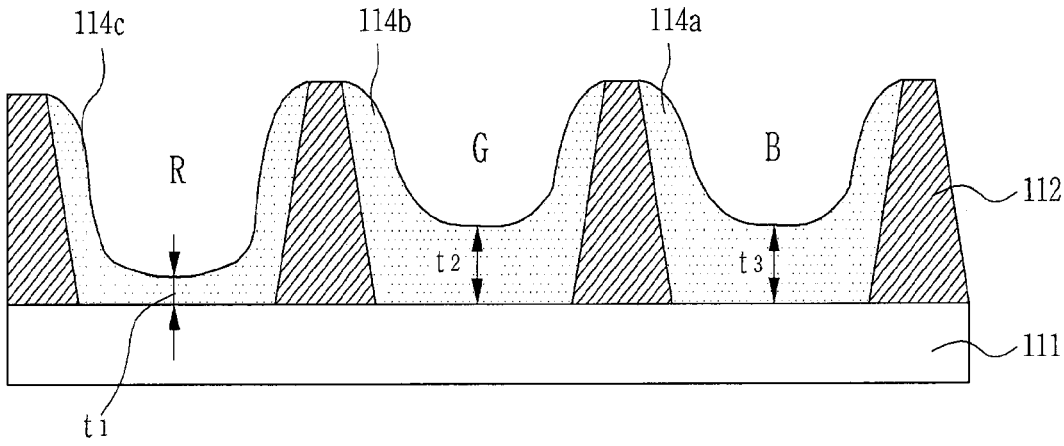

The thickness of at least one of the phosphor layers 114 formed inside the red (R), green (G) and blue (B) discharge cells may be different from the thickness of the other phosphor layers. For instance, as illustrated in FIG. 1*d*, thicknesses t2 and t3 of phosphor layers 114*b* and 114*a* inside the green (G) and blue (B) discharge cells are more than a thickness t1 of a phosphor layer 114*c* inside the red (R) discharge cell. The thickness t2 of the phosphor layer 114*b* inside the green (G) discharge cell may be substantially equal to or different from the thickness t3 of the phosphor layer 114*a* inside the blue (B) discharge cell.

It should be noted that only one example of the plasma display panel according to one embodiment has been illustrated and described above, and the present embodiment is not limited to the plasma display panel of the above-described structure. For instance, while, the above description illustrates a case where the upper dielectric layer 104 and the lower dielectric layer 115 each are formed in the form of a single layer, at least one of the upper dielectric layer 104 and the lower dielectric layer 115 may be formed in the form of a plurality of layers.

A black layer (not illustrated) for absorbing external light may be further formed on the upper portion of the barrier rib 112 to prevent the reflection of the external light caused by the barrier rib 112.

Further, a black matrix (not illustrated) may be further formed at a specific position on the front substrate 101 corresponding to the barrier rib 112.

The third electrode 113 formed on the rear substrate 11 may have a substantially constant width or thickness. Further, the width or thickness of the third electrode 113 inside the discharge cell may be different from the width or thickness of the third electrode 113 outside the discharge cell. For instance, the width or thickness of the third electrode 113 inside the discharge cell may be more than the width or thickness of the third electrode 113 outside the discharge cell.

In this way, the structure of the plasma display panel according to one embodiment may vary in various ways.

As above, the first electrode 102 and the second electrode 103 are formed in the form of a single layer. This will be described in detail below.

Figure 2A:
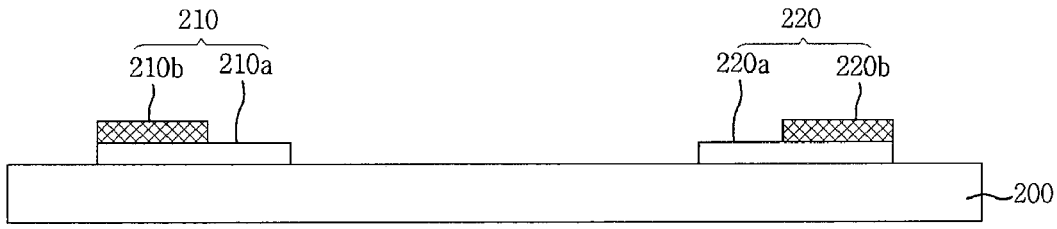
FIGS. 2*a* and 2*b* illustrate a reason why at least one of a first electrode or a second electrode is formed in the form of a single layer.
Figure 2B:
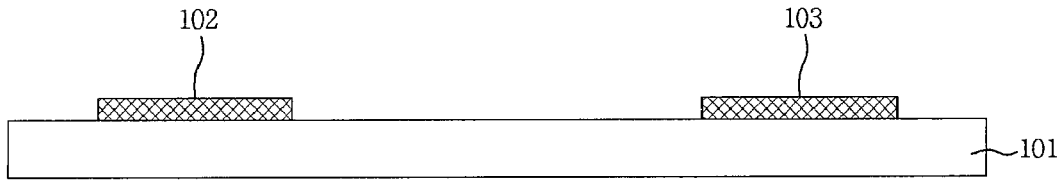

FIGS. 2*a* and 2*b* illustrate a reason why at least one of a first electrode or a second electrode is formed in the form of a single layer.

Referring to FIG. 2*a*, unlike the structure of the plasma display panel according to one embodiment, a first electrode 210 and a second electrode 220 formed on a front substrate 200 are formed in the form of a plurality of layers. More specifically, the first electrode 210 and the second electrode 220 each include transparent electrodes 210*a* and 220*a* and bus electrodes 210*b* and 220*b*.

In FIG. 2*a*, after forming the transparent electrodes 210*a* and 220*a* in a forming process of the first electrode 210 and the second electrode 220, the bus electrodes 210*b* and 220*b* are formed.

On the other hand, referring to FIG. 2*b*, the first electrode 102 and the second electrode 103 in the plasma display panel according to one embodiment are formed in the form of a single layer.

Accordingly, the case illustrated in FIG. 2*a* shows an increase in the number of manufacturing processes and an increase in the manufacturing cost as compared with the case illustrated in FIG. 2*b*.

Further, since the first electrode 210 and the second electrode 220 of FIG. 2*a* include relatively expensive ITO, the manufacturing cost further increases.

In the case illustrated in FIG. 2*b*, the manufacturing process is simple, and the manufacturing cost is reduced without using a relatively expensive material such as ITO.

Figure 3:
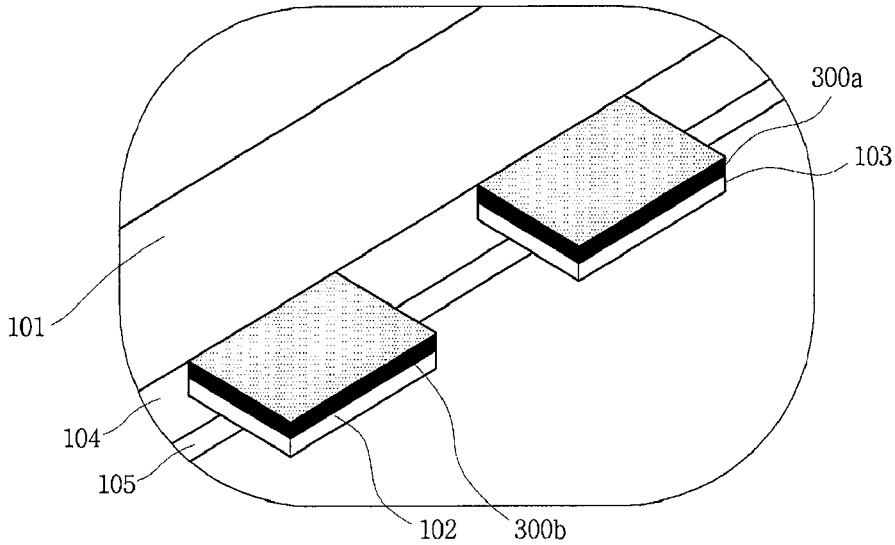
FIG. 3 illustrates one example of a structure in which a black layer is formed between first and second electrodes and a front substrate.

FIG. 3 illustrates one example of a structure in which a black layer is formed between first and second electrodes and a front substrate.

Referring to FIG. 3, black layers 300*a* and 300*b* are formed between the front substrate 101 and the first and second electrodes 102 and 103, thereby preventing discoloration of the front substrate 101. Colors of the black layers 300*a* and 300*b* are darker than a color of at least one of the first and second electrodes 102 and 103.

More specifically, when the front substrate 101 directly contacts the first and second electrodes 102 and 103, a predetermined area of the front substrate 101 directly contacting the first and second electrodes 102 and 103 may change to yellow. The change of color is called a migration phenomenon. The black layers 300*a* and 300*b* prevent the migration phenomenon by preventing the direct contact of the front substrate 101 with the first and second electrodes 102 and 103.

The black layers 300*a* and 300*b* may include a black material of a dark color, for example, ruthenium (Ru).

Since the black layers 300*a* and 300*b* are formed between the front substrate 101 and the first and second electrodes 102 and 103, the generation of reflection light is prevented even if the first and second electrodes 102 and 103 are made of a material with a high reflectivity.

Figure 4A:
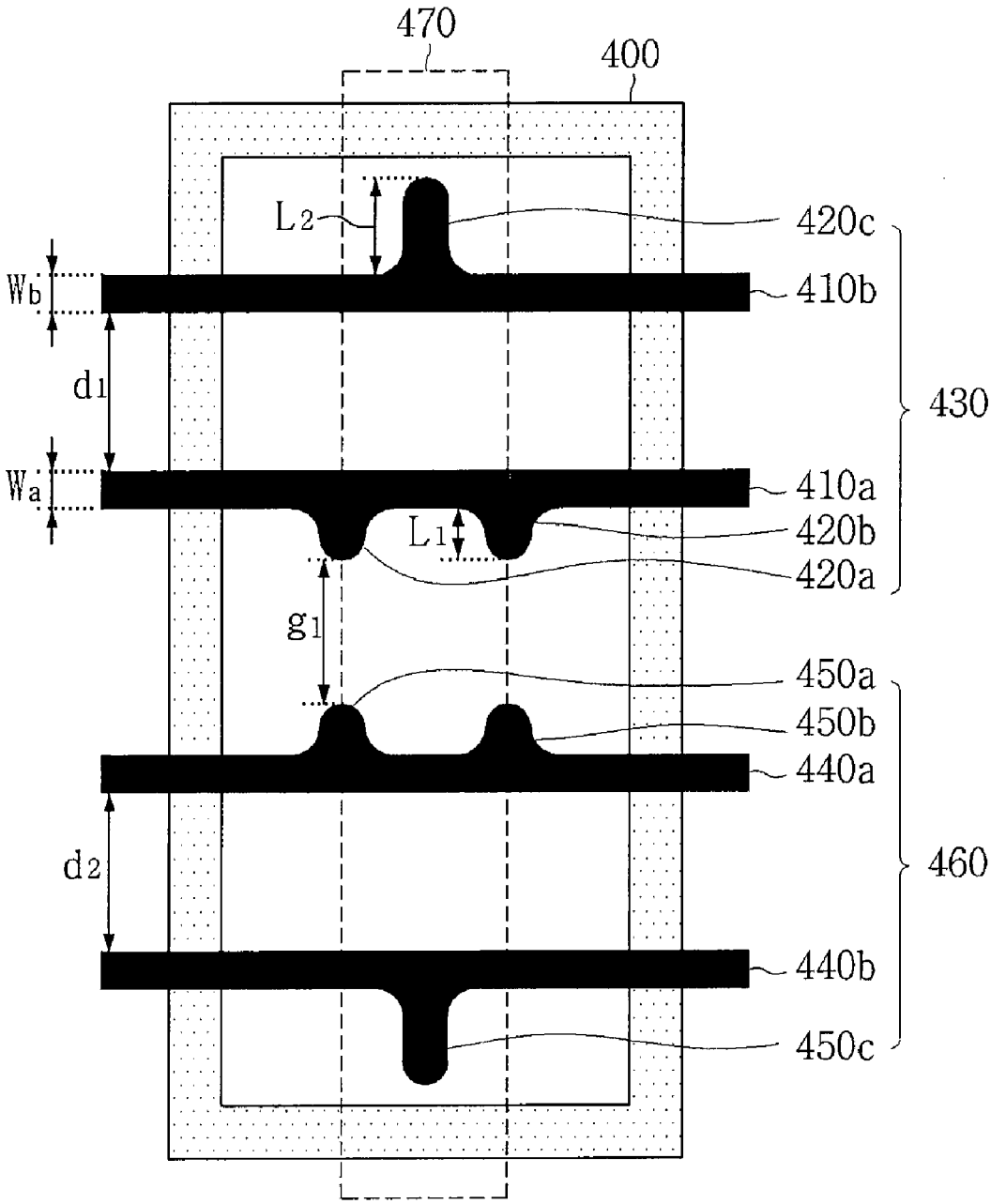
FIGS. 4*a* to 4*c* illustrate a first example associated with a first electrode and a second electrode in the plasma display panel according to one embodiment.
Figure 4B:
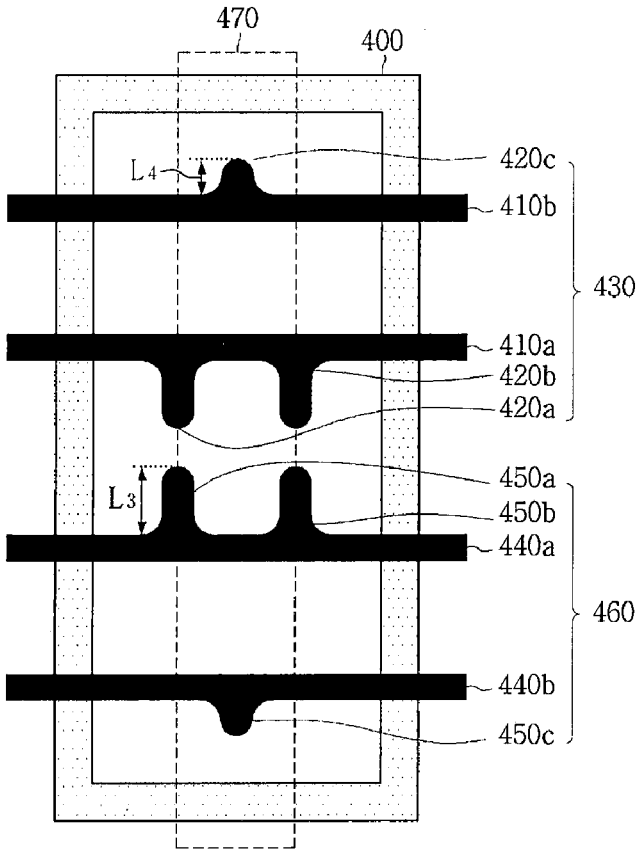
Figure 4C:
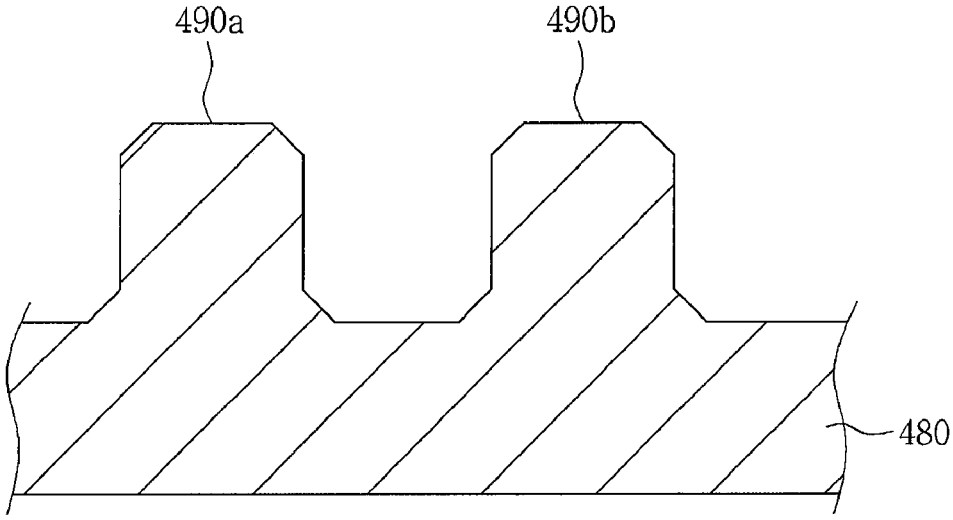

FIGS. 4*a* to 4*c* illustrate a first example associated with a first electrode and a second electrode in the plasma display panel according to one embodiment.

At least one of a first electrode 430 or a second electrode 460 may include at least one line portion. Referring to FIG. 4*a*, the first electrode 430 includes two line portions 410*a* and 410*b*, and the second electrode 460 includes two line portions 440*a* and 440*b*.

The line portions 410*a*, 410*b*, 440*a* and 440*b* each intersect a third electrode 470 inside a discharge cell partitioned by a barrier rib 400.

The line portions 410*a*, 410*b*, 440*a* and 440*b* are spaced from one another with a predetermined distance therebetween.

For example, the first and second line portions 410*a* and 410*b* of the first electrode 430 are spaced from each other with a distance d1 therebetween. The first and second line portions 440*a* and 440*b* of the second electrode 460 are spaced from each other with a distance d2 therebetween. The distance d1 may be equal to or different from the distance d2.

Further, two or more line portions may be adjacent to each other.

The line portions 410*a*, 410*b*, 440*a* and 440*b* each may have a predetermined width. For example, the first line portion 410*a* of the first electrode 430 has a width of Wa, and the second line portion of the first electrode 430 has a width of Wb.

The shape of the first electrode 430 may be symmetrical or asymmetrical to the shape of the second electrode 460 inside the discharge cell. For example, while the first electrode 430 may include three line portions, the second electrode 460 may include two line portions.

The number of line portions in the first and second electrodes 430 and 460 may vary. For example, the first electrode 430 or the second electrode 460 may include 4 or 5 line portions.

At least one of the first electrode 430 or the second electrode 460 may include at least one projection portion. For example, the first electrode 430 includes projection portions 420*a*, 420*b* and 420*c* projecting from the line portions 410*a* and 410*b*, and the second electrode 460 includes projection portions 450*a*, 450*b* and 450*c* projecting from the line portions 440*a* and 440*b*. The projection portions 420*a*, 420*b*, 420*c*, 450*a*, 450*b* and 450*c* may be parallel to the third electrode 470.

The shape of at least one of the projection portions 420*a*, 420*b*, 420*c*, 450*a*, 450*b* and 450*c* is different from the shape of the other projection portions.

The projection portions 420*a* and 420*b* of the first electrode 430 and the projection portions 450*a* and 450*b* of the second electrode 460 projecting toward the center of the discharge cell are called a first projection portion. A direction directing toward the center of the discharge cell is called a first direction.

The projection portion 420*c* of the first electrode 430 and the projection portion 450*c* of the second electrode 460 projecting toward a second direction opposite the first direction are called a second projection portion.

A length L1 of the first projection portions 420*a*, 420*b*, 450*a* and 450*b* is different from a length L2 of the second projection portions 420*c* and 450*c*. For example, the length L2 of the second projection portions 420*c* and 450*c* is longer than the length L1 of the first projection portions 420*a*, 420*b*, 450*a* and 450*b*.

By making the length L2 of the second projection portions 420*c* and 450*c* to be longer than the length L1 of the first projection portions 420*a*, 420*b*, 450*a* and 450*b*, a discharge generated between the first projection portions 420*a* and 420*b* of the first electrode 430 and the first projection portions 450*a* and 450*b* of the second electrode 460 is easily diffused into the back of the discharge cell through the second projection portion 420*c* of the first electrode 430 and the second projection portion 450*c* of the second electrode 460. Accordingly, the quantity of light generated by a discharge performed one time increases, and the driving efficiency is improved.

Referring to FIG. 4*b*, a length L3 of the first projection portions 420*a*, 420*b*, 450*a* and 450*b* is longer than a length L4 of the second projection portions 420*c* and 450*c*.

By making the length L3 of the first projection portions 420*a*, 420*b*, 450*a* and 450*b* to be longer than the length L4 of the second projection portions 420*c* and 450*c*, a gap g1 between the first electrode 430 and the second electrode 460 is reduced. Therefore, a firing voltage between the first electrode 430 and the second electrode 460 is reduced such that the driving efficiency is improved.

The gap g1 between the first electrode 430 and the second electrode 460, i.e., the gap g1 between the first projection portions 420*a* and 420*b* of the first electrode 430 and the first projection portions 450*a* and 450*b* of the second electrode 460 may range from 60 μm to 120 μm.

In a case where the lengths L1, L2, L3 and L4 of the projection portions 420*a*, 420*b*, 420*c*, 450*a*, 450*b* and 450*c* are excessively long, an aperture ratio in an active area (refer to FIG. 9) which are described later is reduced. On the other hand, in a case where the lengths L1, L2, L3 and L4 of the projection portions 420*a*, 420*b*, 420*c*, 450*a*, 450*b* and 450*c* are excessively short, the discharge is not sufficiently diffused into the back of the discharge cell or the firing voltage between the first electrode 430 and the second electrode 460 increases excessively. To solve the above-described problems, the length of at least one of the projection portions 420*a*, 420*b*, 420*c*, 450*a*, 450*b* and 450*c* is set to about 30-100 μm. Accordingly, the discharge is sufficiently diffused into the back of the discharge cell, and an excessive increase in the firing voltage between the first electrode 430 and the second electrode 460 is prevented. Further, at least one of the projection portions 420*a*, 420*b*, 420*c*, 450*a*, 450*b* and 450*c* may overlap the third electrode 470 inside the discharge cell. In this case, a firing voltage between the first electrode 430 and the third electrode 470 is reduced. As a result, a driving efficiency is improved and an address jitter characteristic is improved. As illustrated in FIGS. 4*a* and 4*b*, at least one of the projection portions 420*a*, 420*b*, 420*c*, 450*a*, 450*b* and 450*c* includes a portion with the curvature. As a result, the first electrode 430 and the second electrode 460 are easy to manufacture. Further, the portion with the curvature prevents wall charges from being excessively accumulated on specific portions of the projection portions 420*a*, 420*b*, 420*c*, 450*a*, 450*b* and 450*c* such that a discharge characteristic is stable and a driving stability is improved.

On the other hand, as illustrated in FIG. 4*c*, projection portions 490*a* and 490*b* projecting from a line portion 480 do not include a portion with the curvature, and are formed in a polygonal shape.

As above, the shape of the projection portion may be changed variously.

Figure 5A:
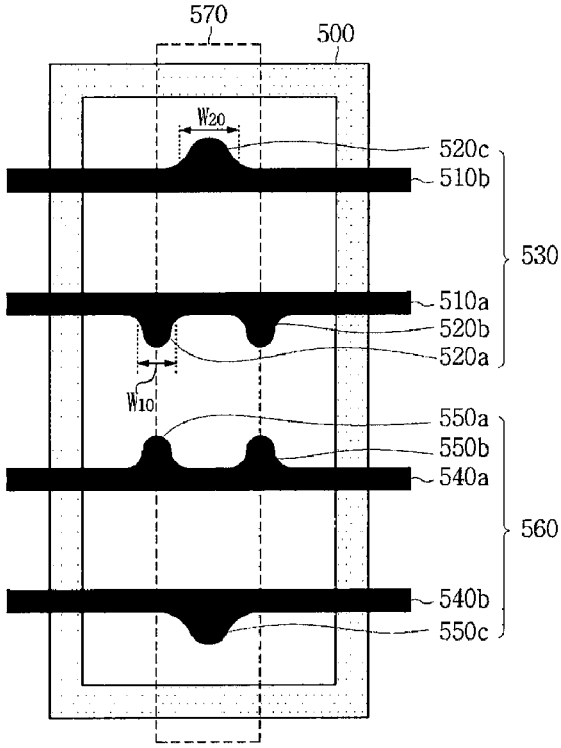
FIGS. 5*a* to 5*c* illustrate a second example associated with a first electrode and a second electrode in the plasma display panel according to one embodiment.
Figure 5B:
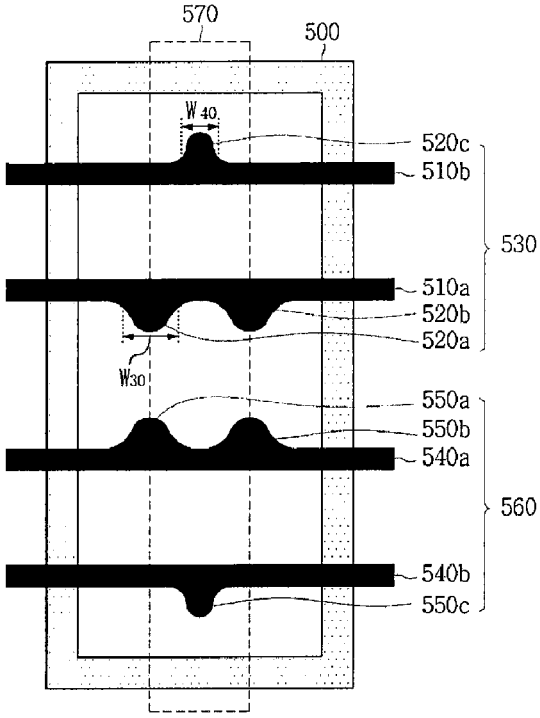
Figure 5C:
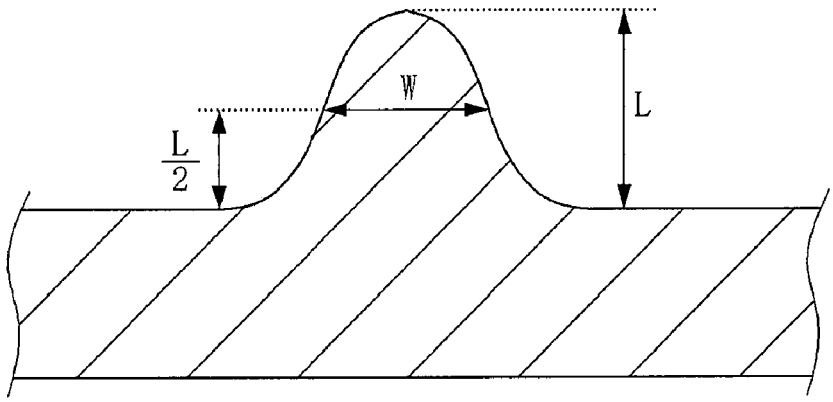

FIGS. 5*a* to 5*c* illustrate a second example associated with a first electrode and a second electrode in the plasma display panel according to one embodiment. The description of structures and components identical or equivalent to those illustrated and described in FIGS. 4*a* to 4*c* is briefly made or is entirely omitted.

Referring to FIG. 5*a*, the width of at least one of a plurality of projection portions 520*a*, 520*b*, 520*c*, 550*a*, 550*b* and 550*c* is different from the widths of the others.

In FIG. 5*a*, the projection portions 520*a*, 520*b*, 550*a* and 550*b* projecting toward the first direction are called a first projection portion. The projection portions 520*c* and 550*c* projecting toward the second direction are called a second projection portion.

A width W10 of the first projection portions 520*a*, 520*b*, 550*a* and 550*b* is different from a width W20 of the second projection portions 520*c* and 550*c*. For example, the width W20 of the second projection portions 520*c* and 550*c* is more than the width W10 of the first projection portions 520*a*, 520*b*, 550*a* and 550*b*.

By making the width W20 of the second projection portions 520*c* and 550*c* to be more than the width W10 of the first projection portions 520*a*, 520*b*, 550*a* and 550*b*, a discharge generated between the first projection portions 520*a* and 520*b* of a first electrode 530 and the first projection portions 550*a* and 550*b* of a second electrode 560 is easily diffused into the back of the discharge cell through the second projection portion 520*c* of the first electrode 530 and the second projection portion 550*c* of the second electrode 560. Accordingly, the quantity of light generated by a discharge performed one time increases, and the driving efficiency is improved.

Referring to FIG. 5*b*, a width W30 of the first projection portions 520*a*, 520*b*, 550*a* and 550*b* is more than a width W40 of the second projection portions 520*c* and 550*c*.

By making the width W30 of the first projection portions 520*a*, 520*b*, 550*a* and 550*b* to be more than the width W40 of the second projection portions 520*c* and 550*c*, the amount of wall charges accumulated on the first projection portions 520*a*, 520*b*, 550*a* and 550*b* increases. Therefore, a firing voltage between the first electrode 530 and the second electrode 560 is reduced such that the driving efficiency is improved.

In a case where the widths W10, W20, W30 and W40 of the projection portions 520*a*, 520*b*, 520*c*, 550*a*, 550*b* and 550*c* are excessively wide, the aperture ratio in the active area is reduced. On the other hand, in a case where the widths W10, W20, W30 and W40 of the projection portions 520*a*, 520*b*, 520*c*, 550*a*, 550*b* and 550*c* are excessively narrow, the discharge is not sufficiently diffused into the back of the discharge cell or the firing voltage between the first electrode 530 and the second electrode 560 increases excessively, To solve the above-described problems, the width of at least one of the projection portions 520*a*, 520*b*, 520*c*, 550*a*, 550*b* and 550*c* is set to about 30-70 μm. Accordingly, the discharge is sufficiently diffused into the back of the discharge cell, and an excessive increase in the firing voltage between the first electrode 530 and the second electrode 560 is prevented.

The widths W10, W20, W30 and W40 of the projection portions 520*a*, 520*b*, 520*c*, 550*a*, 550*b* and 550*c* are measured at a position corresponding to L/2 when the height of the projection portions is L as illustrated in FIG. 5*c*.

Figure 6A:
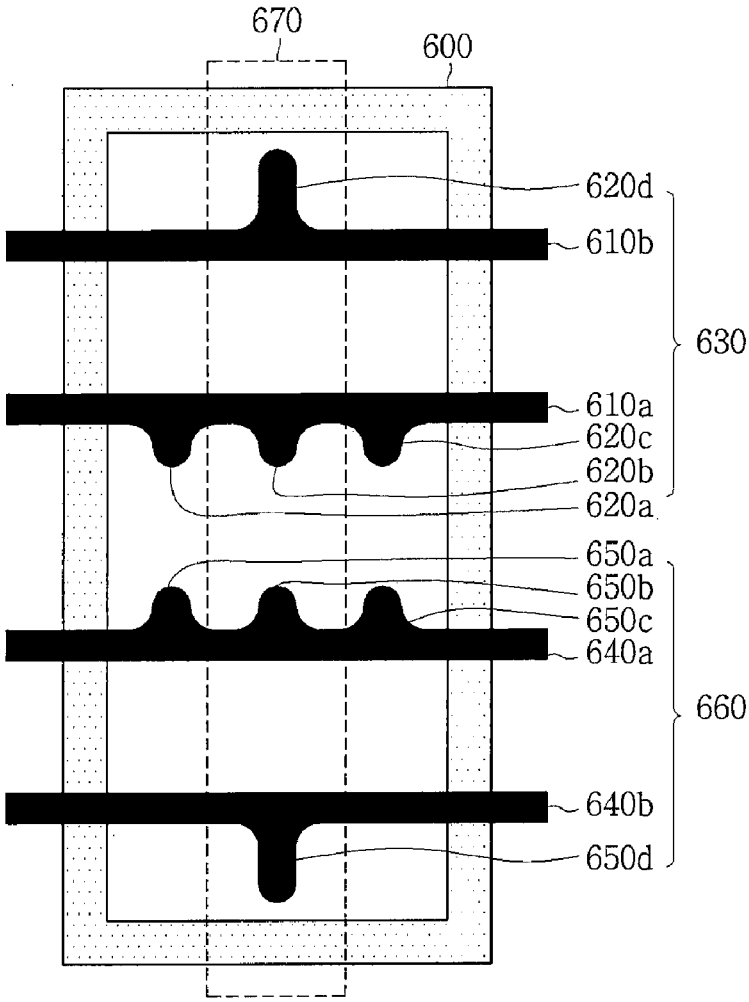
FIGS. 6*a* and 6*b* illustrate a third example associated with a first electrode and a second electrode in the plasma display panel according to one embodiment.
Figure 6B:
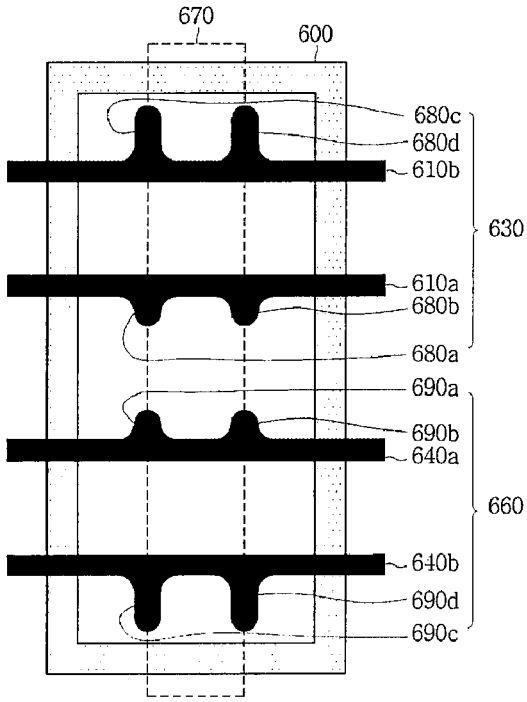

FIGS. 6*a* and 6*b* illustrate a third example associated with a first electrode and a second electrode in the plasma display panel according to one embodiment. The description of structures and components identical or equivalent to those illustrated and described in FIGS. 4*a* to 4*c* is briefly made or is entirely omitted.

Referring to FIG. 6*a*, a first electrode 630 includes three first projecting portions 620*a*, 620*b* and 620*c* projecting toward the first direction, and a second electrode 660 includes three first projecting portions 650*a*, 650*b* and 650*c* projecting toward the first direction.

The first electrode 630 and the second electrode 660 each may include one first projecting portion. As above, the number of first projecting portions may be changed variously.

Referring to FIG. 6*b*, the first electrode 630 includes two second projecting portions 680*c* and 680*d* projecting toward the second direction, and the second electrode 660 includes two second projecting portions 690*c* and 690*d* projecting toward the second direction.

The first electrode 630 and the second electrode 660 each may include three second projecting portions. As above, the number of second projecting portions may be changed variously.

Figure 7A:
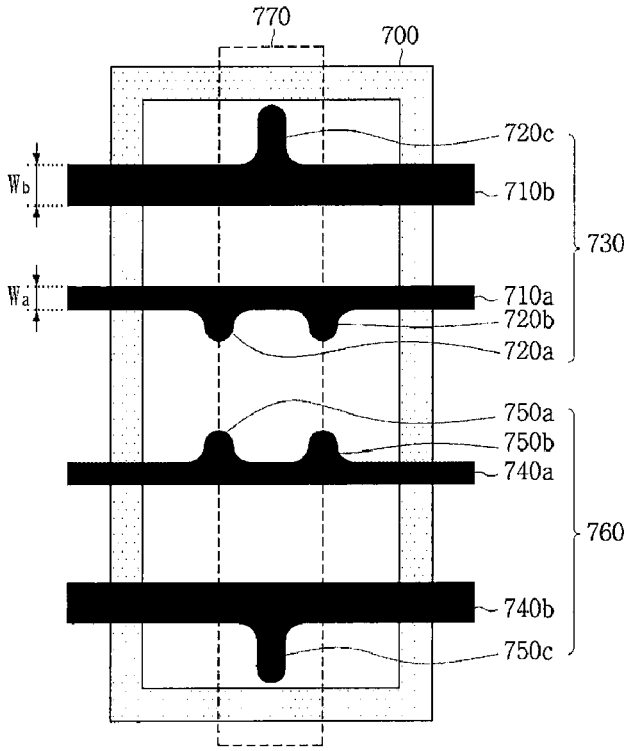
FIGS. 7*a* and 7*b* illustrate a fourth example associated with a first electrode and a second electrode in the plasma display panel according to one embodiment.
Figure 7B:
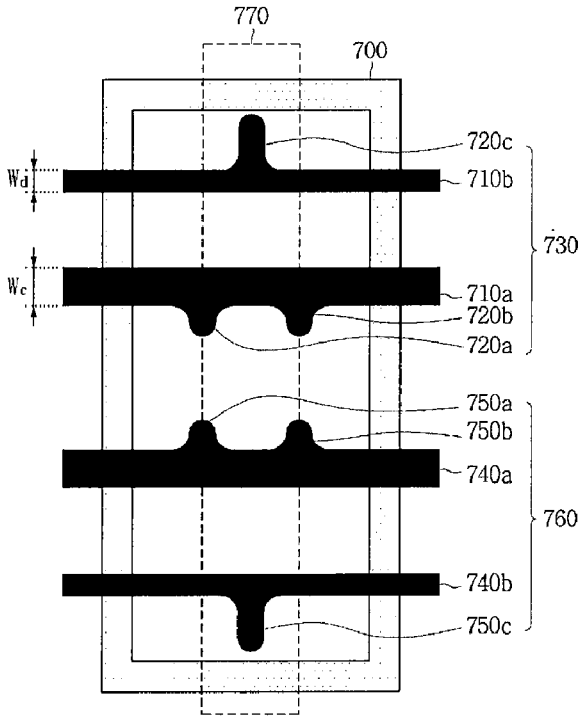

FIGS. 7*a* and 7*b* illustrate a fourth example associated with a first electrode and a second electrode in the plasma display panel according to one embodiment. The description of structures and components identical or equivalent to those illustrated and described in FIGS. 4*a* to 4*c* is briefly made or is entirely omitted.

The width of at least one of a plurality of line portions 710*a*, 710*b*, 740*a* and 740*b* may be different from the width of the others. As illustrated in FIG. 7*a*, a width Wa of the first line portion 710*a* of a first electrode 730 is less than a width Wb of the second line portion 710*b* of the first electrode 730.

As illustrated in FIG. 7*b*, a width Wc of the first line portion 710*a* of the first electrode 730 is more than a width Wd of the second line portion 710*b* of the first electrode 730.

As above, the shape of the line portion may changed variously.

Figure 8A:
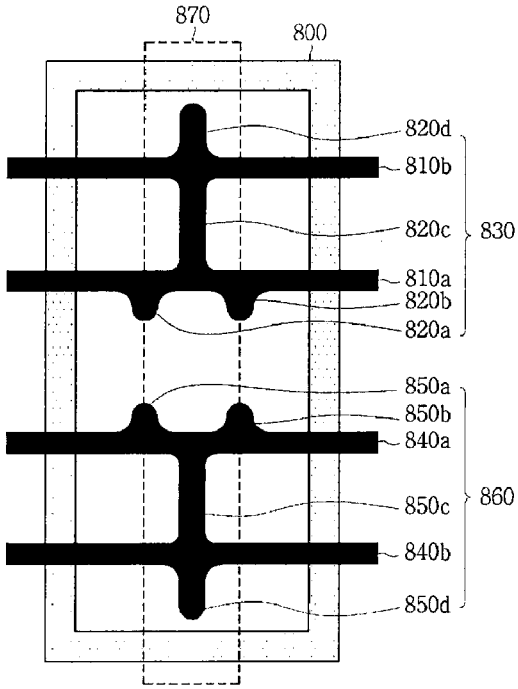
FIGS. 8*a* and 8*b* illustrate a fifth example associated with a first electrode and a second electrode in the plasma display panel according to one embodiment.
Figure 8B:
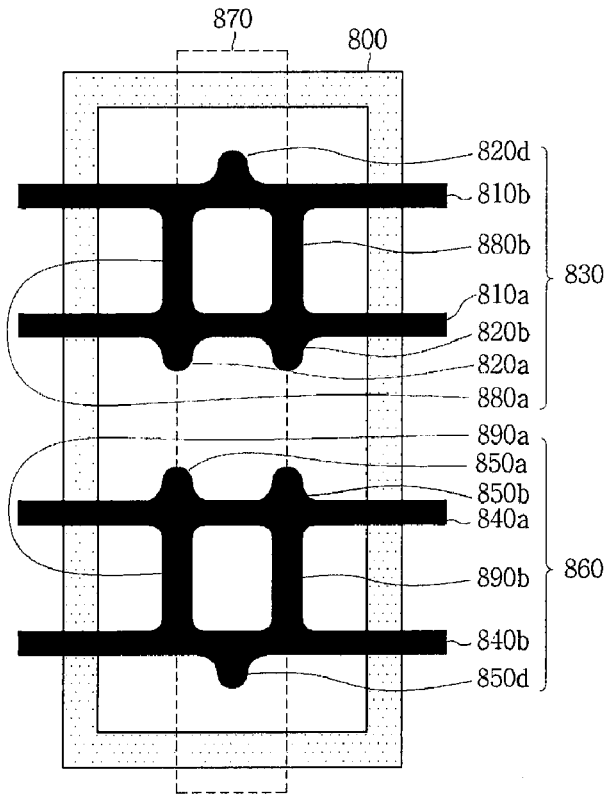

FIGS. 8*a* and 8*b* illustrate a fifth example associated with a first electrode and a second electrode in the plasma display panel according to one embodiment. The description of structures and components identical or equivalent to those illustrated and described in FIGS. 4*a* to 4*c* is briefly made or is entirely omitted.

A first electrode 830 and a second electrode 860 each may further include a connecting portion connecting two or more line portions.

As illustrated in FIG. 8*a*, a connecting portion 820*c* of the first electrode 830 connects first and second line portions 810*a* and 810*b* of the first electrode 830 to each other. A connecting portion 850*c* of the second electrode 860 connects first and second line portions 840*a* and 840*b* of the second electrode 860 to each other.

Accordingly, a discharge generated between first projection portions 820*a* and 820*b* of the first electrode 830 and first projection portions 850*a* and 850*b* of the second electrode 860 is easily diffused into the second line portion 810*b* of the first electrode 830 and the second line portion 840*b* of the second electrode 860 through the connecting portion 820*c* of the first electrode 830 and the connecting portion 850*c* of the second electrode 860.

Each of portions where the connecting portions 820*c* and 850*c* and the line portions 810*a*, 810*b*, 840*a* and 840*b* abut each other may have the curvature.

The first electrode 830 and the second electrode 860 each include one connecting portion, i.e., the connecting portions 820*c* and 850*c* in FIG. 8*a*. However, as illustrated in FIG. 8*b*, the first electrode 830 includes two connecting portions 880*a* and 880*b*, and the second electrode 860 includes two connecting portions 890*a* and 890*b*.

As above, the number of connecting portions may be changed variously.

Figure 9:
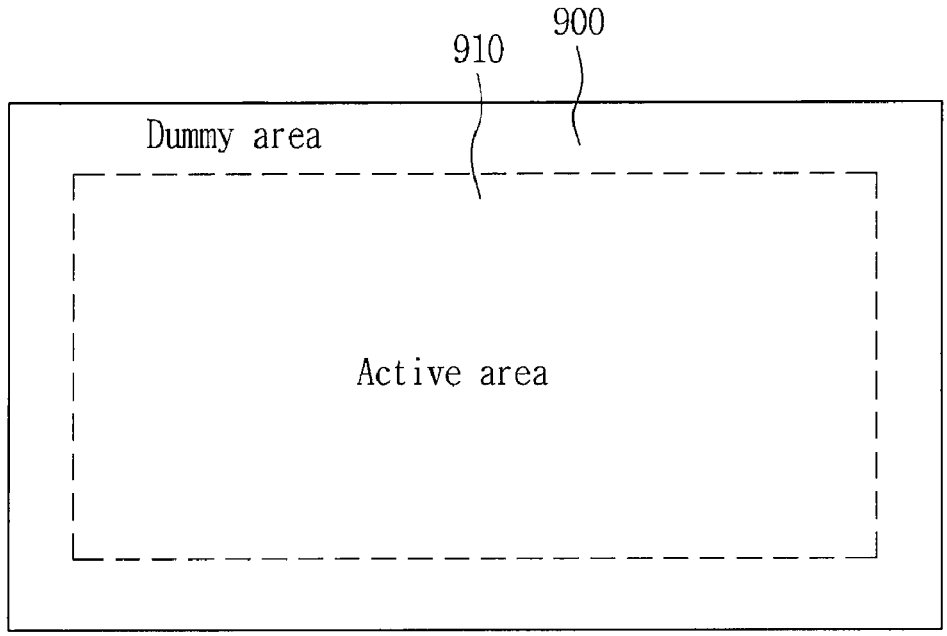
FIG. 9 illustrates a dummy area and an active area.

FIG. 9 illustrates a dummy area and an active area.

Referring to FIG. 9, the plasma display panel includes an active area 910 on which an image is displayed, and a dummy area 900 which does not contribute to an image display. The active area 910 is referred to as an area where the image is displayed due to the generation of visible light when driving the plasma display panel. Since the active area 910 was described in detail above, the description thereof is omitted.

The dummy area 900 is disposed to the exterior of the active area 910. The dummy area 900 secures a structural stability of the active area 910, or secures an operation stability in the active area 910.

The phosphor layer may not be formed inside a discharge cell formed in the dummy area 900, i.e., a dummy discharge cell. Or, at least one of the first, second or third electrodes may not be formed inside the dummy discharge cell.

A part of light generated inside the plasma display panel is emitted to the outside of the plasma display panel. On the other hand, a part is not emitted to the outside, and is blocked by the first and second electrodes, the black layer, and the black matrix, and the like, formed on the front substrate.

A ratio of an area of the remaining portion except a portion of the active area 910 covered with the first and second electrodes, the black layer, and the black matrix, and the like, formed on the front substrate to the gross area of the active area 910 is referred to as an aperture ratio.

The aperture ratio in the plasma display panel according to one embodiment ranges from 25% to 45% in terms of percentage. When the aperture ratio is less than 25%, the luminance of the image displayed on the active area 910 is excessively low. Further, when the aperture ratio is more than 45%, it is disadvantages to the plasma display panel. In other words, if the width or the area of the first and second electrodes decreases so as to raise the aperture ratio to be more than 45%, the firing voltage increases such that the driving efficiency is reduced.

Figure 10:
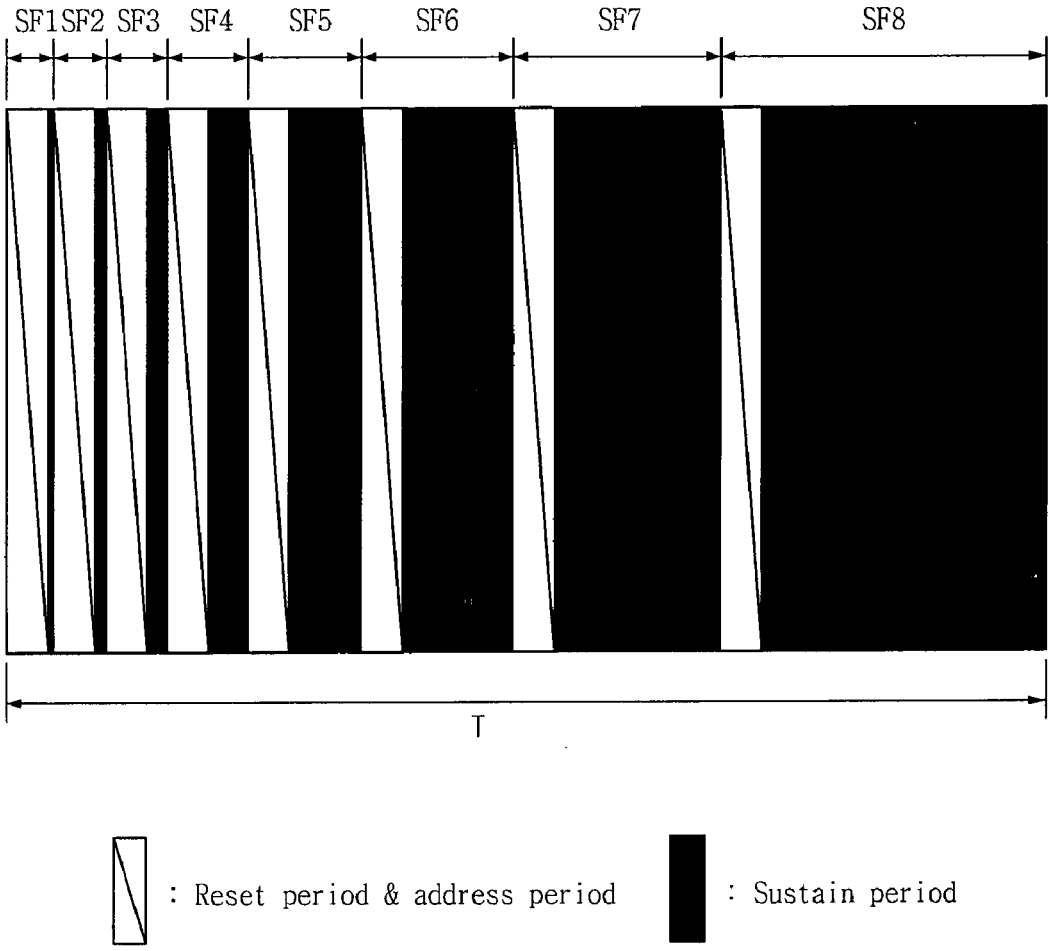
FIG. 10 illustrates a frame for achieving a gray level of an image displayed on the plasma display panel according to one embodiment.

FIG. 10 illustrates a frame for achieving a gray level of an image displayed on the plasma display panel according to one embodiment.

Referring to FIG. 10, a frame for achieving a gray level of an image displayed on the plasma display panel according to one embodiment is divided into several subfields each having a different number of emission times.

Each subfield is subdivided into a reset period for initializing all the cells, an address period for selecting cells to be discharged, and a sustain period for representing gray level in accordance with the number of discharges.

For example, if an image with 256-level gray level is to be displayed, a frame, as illustrated in FIG. 10, is divided into 8 subfields SF1 to SF8. Each of the 8 subfields SF1 to SF8 is subdivided into a reset period, an address period, and a sustain period.

The number of sustain signals supplied during the sustain period determines gray level weight in each of the subfields. For example, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

The plasma display panel according to one embodiment uses a plurality of frames to display an image during 1 second. For example, 60 frames are used to display an image during 1 second. In this case, a duration T of time of one frame may be 1/60 seconds, i.e., 16.67 ms.

Although FIG. 10 has illustrated and described a case where one frame includes 8 subfields, the number of subfields constituting one frame may vary. For example, one frame may include 12 subfields or 10 subfields.

Further, although FIG. 10 has illustrated and described the subfields arranged in increasing order of gray level weight, the subfields may be arranged in decreasing order of gray level weight, or the subfields may be arranged regardless of gray level weight.

Figure 11:
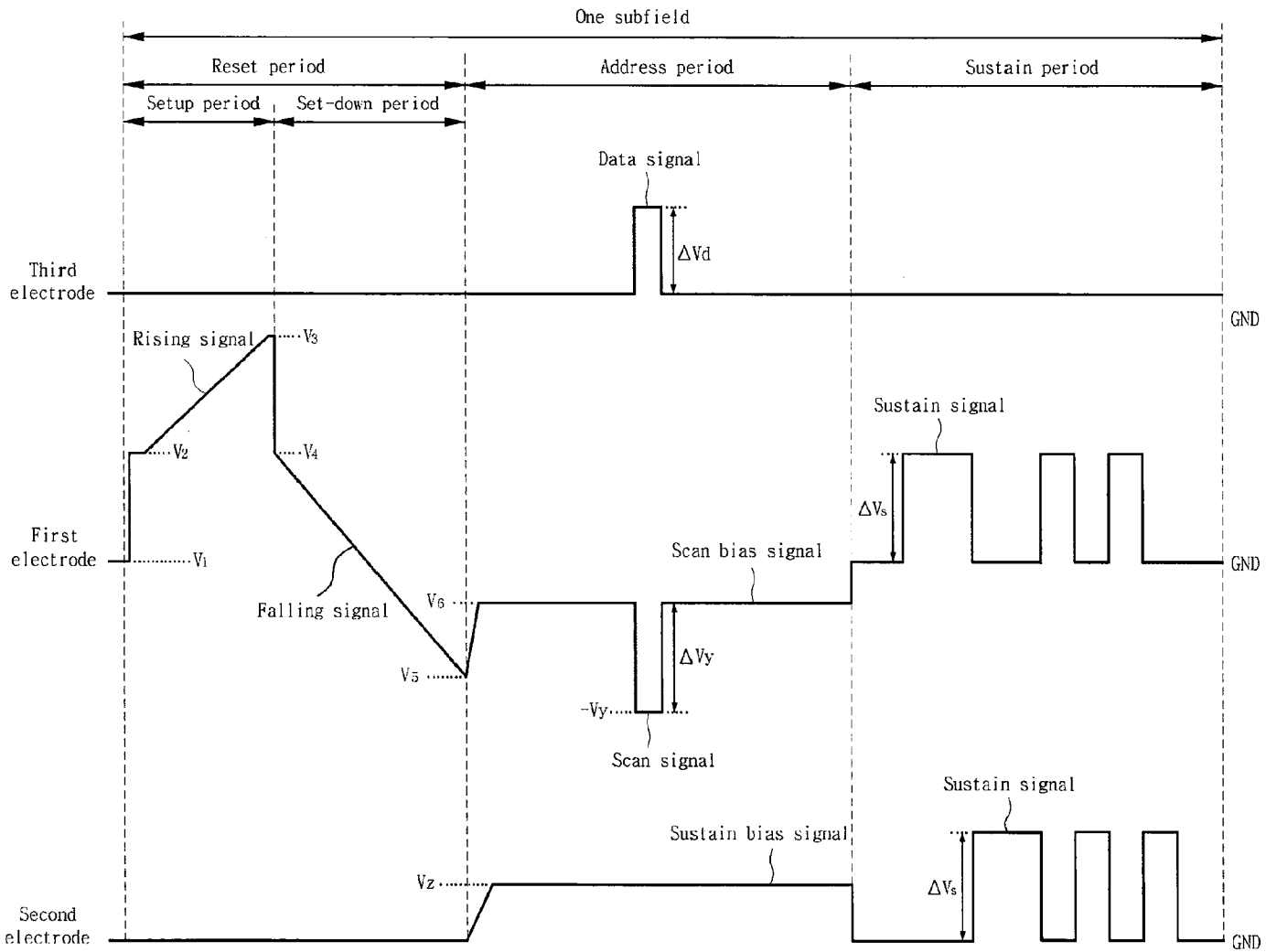
FIG. 11 illustrates one example of an operation of the plasma display panel according to one embodiment during one subfield of a frame.

FIG. 11 illustrates one example of an operation of the plasma display panel according to one embodiment during one subfield of a frame.

Referring to FIG. 11, a reset period is further divided into a setup period and a set-down period. During the setup period, a rising signal is supplied to the first electrode. The rising signal sharply rises from a first voltage V1 to a second voltage V2, and then gradually rises from the second voltage V2 to a third voltage V3. The first voltage V1 is equal to a ground level voltage GND.

The rising signal generates a weak dark discharge (i.e., a setup discharge) inside a discharge cell during the setup period, thereby accumulating a proper amount of wall charges inside the discharge cell.

During the set-down period, a falling signal of a polarity direction opposite a polarity direction of the rising signal is supplied to the first electrode.

The falling signal gradually falls from a fourth voltage V4, that is lower than the highest voltage (i.e., the third voltage V3) of the rising signal, to a fifth voltage V5.

The falling signal generates a weak erase discharge (i.e., a set-down discharge) inside the discharge cell. Furthermore, the remaining wall charges are uniform inside the discharge cells to the extent that an address discharge can be stably performed.

The rising signal and the falling signal may be changed in various forms.

Figure 12A:
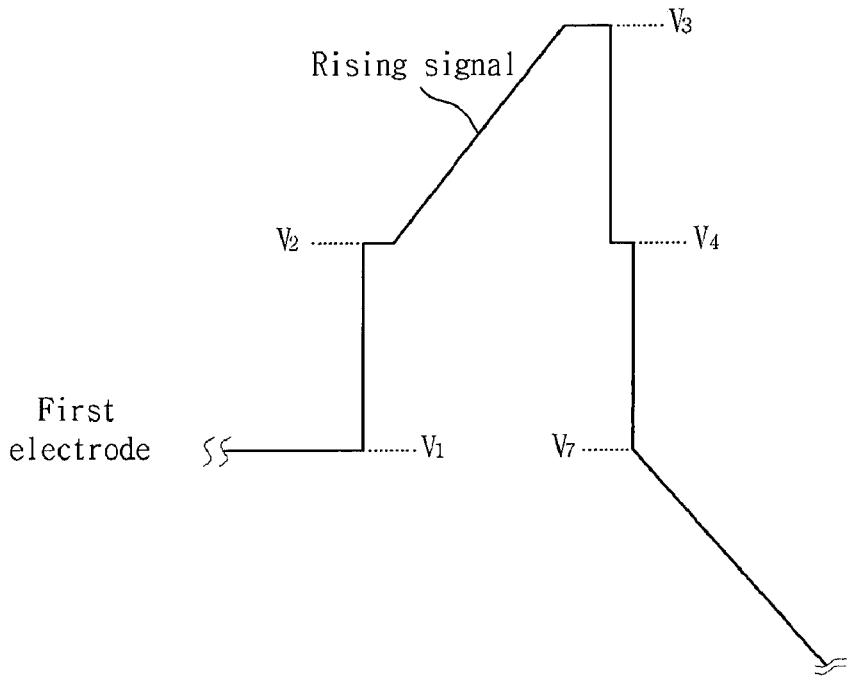
FIGS. 12*a* and 12*b* illustrate another form of a rising signal and a falling signal.
Figure 12B:
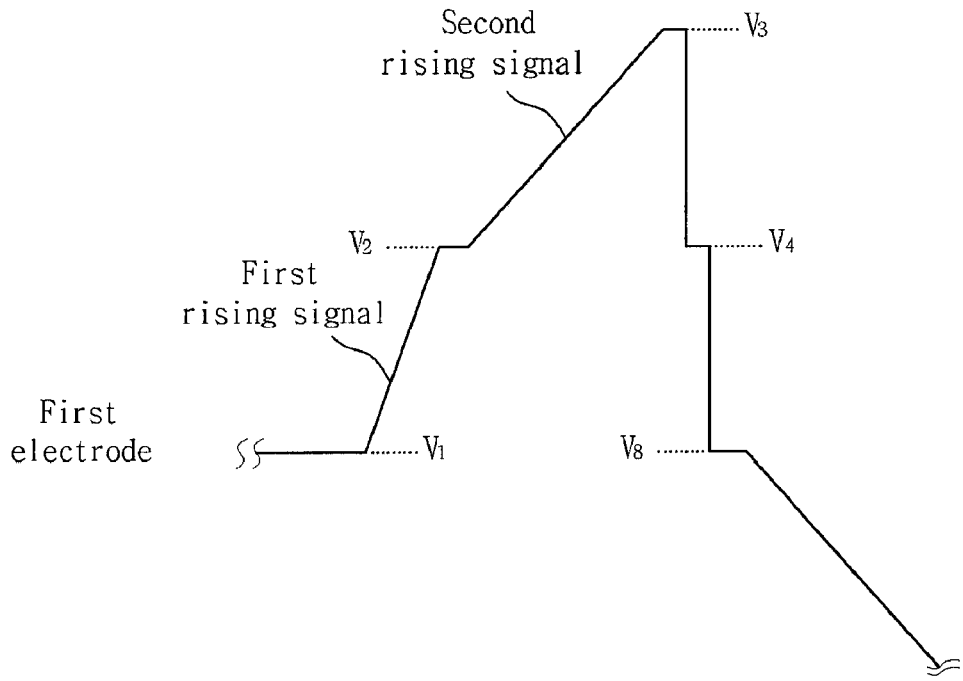

FIGS. 12*a* and 12*b* illustrate another form of a rising signal and a falling signal.

Referring to FIG. 12*a*, a falling signal gradually falls from a seventh voltage V7, that is lower than the fourth voltage V4. In other words, a voltage of the first electrode may be changed at a supply start time point of the falling signal. The seventh voltage V7 may be substantially equal to the first voltage V1.

Referring to FIG. 12*b*, a rising signal includes a first rising signal and a second rising signal each having a different rising slope.

The first rising signal gradually rises from the first voltage V1 to the second voltage V2 with a first slope. The second rising signal gradually rises from the second voltage V2 to the third voltage V3 with a second slope.

The second slope of the second rising signal is gentler than the first slope of the first rising signal. When the second slope is gentler than the first slope, the voltage of the rising signal rises relatively rapidly until the setup discharge occurs, and the voltage of the rising signal rises relatively slowly during the generation of the setup discharge. As a result, the quantity of light generated by the setup discharge is reduced. Accordingly, contrast of the plasma display panel is improved.

An eighth voltage V8 of FIG. 12*b* may be substantially equal to the seventh voltage V7 of FIG. 12*a*.

The subfield may include a pre-reset period prior to the reset period. The following is a detailed description of the pre-reset period with reference to FIG. 13.

Figure 13:
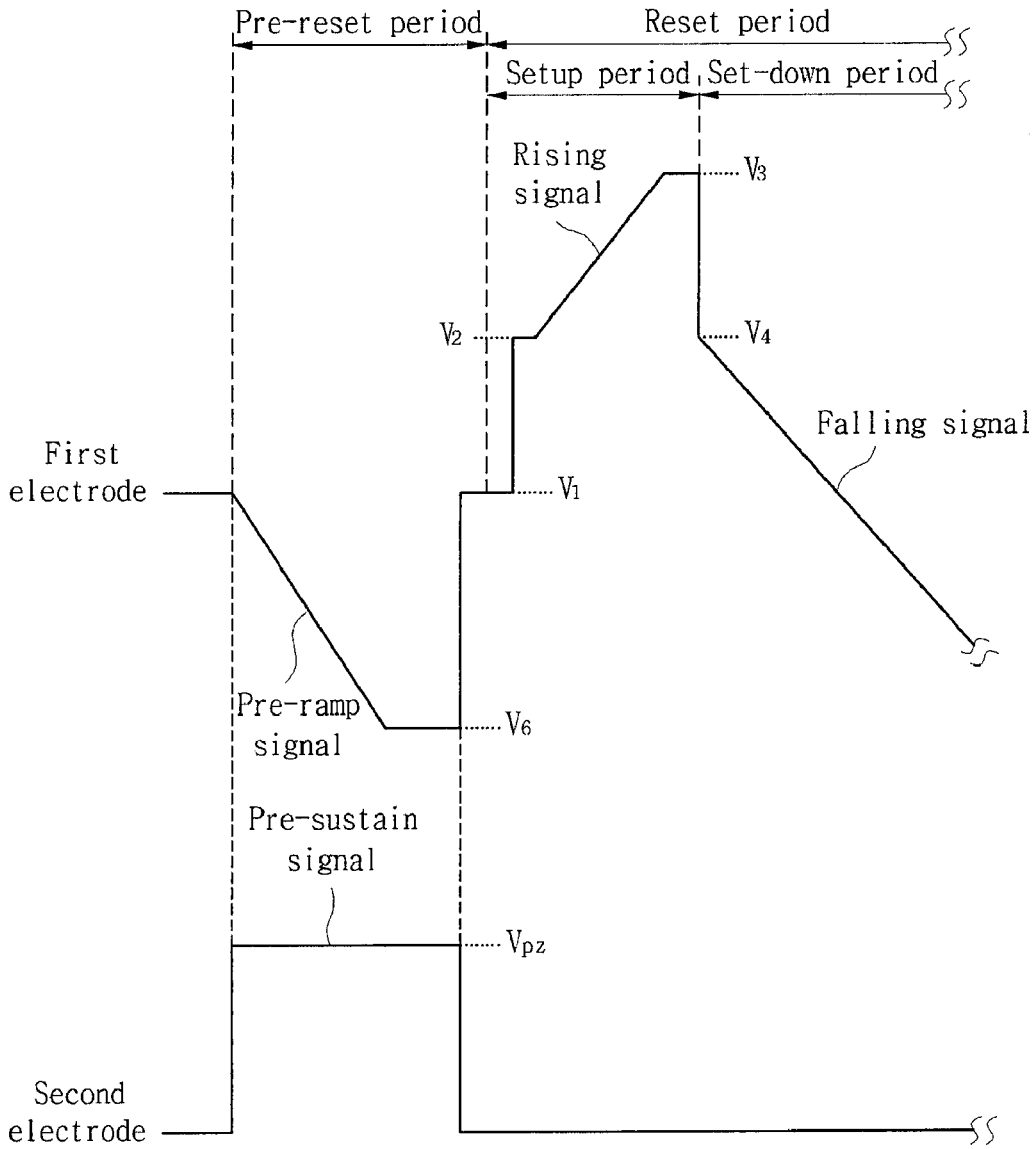
FIG. 13 illustrates a pre-reset period.

FIG. 13 illustrates a pre-reset period.

Referring to FIG. 13, the subfield further includes a pre-reset period prior to the reset period. During the pre-reset period, a pre-ramp signal gradually falling to a sixth voltage V6 is supplied to the first electrode.

During the supplying of the pre-ramp signal to the first electrode, a pre-sustain signal of a polarity direction opposite a polarity direction of the pre-ramp signal is supplied to a second electrode.

The pre-sustain signal is constantly maintained at a pre-sustain voltage Vpz. The pre-sustain voltage Vpz may be substantially equal to a voltage (i.e., a sustain voltage Vs) of a sustain signal which will be supplied during a sustain period.

As above, during the pre-reset period, the pre-ramp signal is supplied to the first electrode and the pre-sustain signal is supplied to the second electrode. As a result, wall charges of a predetermined polarity are accumulated on the first electrode, and wall charges of a polarity opposite the polarity of the wall charges accumulated on the first electrode are accumulated on the second electrode. For example, wall charges of a positive polarity are accumulated on the first electrode, and wall charges of a negative polarity are accumulated on the second electrode.

As a result, a setup discharge with a sufficient strength occurs during the reset period such that the initialization of all the discharge cells is performed stably.

Furthermore, although a voltage of a rising signal supplied to the first electrode during the reset period is low, a setup discharge with a sufficient strength occurs.

A subfield, which is first arranged in time order in a plurality of subfields of one frame, may include a pre-reset period prior to a reset period so as to obtain sufficient driving time. Or, two or three subfields may include a pre-reset period prior to a reset period.

All the subfields may not include the pre-reset period.

Referring again to FIG. 11, during an address period, a scan bias signal, which is maintained at a voltage (i.e., the sixth voltage V6) higher than the lowest voltage (i.e., the fifth voltage V5) of the falling signal, is supplied to the first electrode.

A scan signal, which falls from the fifth voltage V5 of the scan bias signal by a scan voltage magnitude ΔVy, is supplied to the first electrode.

The width of the scan signal may vary from one subfield to the next subfield. In other words, the width of a scan signal in at least one subfield may be different from the width of a scan signal in the other subfields. For example, the width of a scan signal in a subfield may be more than the width of a scan signal in the next subfield in time order. Further, the width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, 1.9 μs, 1.9 μs, etc.

As above, when the scan signal is supplied to the first electrode, a data signal corresponding to the scan signal is supplied to the third electrode. The data signal rises from a ground level voltage GND by a data voltage magnitude ΔVd.

As the voltage difference between the scan signal and the data signal is added to the wall voltage generated during the reset period, the address discharge is generated within the discharge cell to which the data signal is supplied.

A sustain bias signal is supplied to the second electrode during the address period to prevent the generation of the unstable address discharge by interference of the second electrode.

The sustain bias signal is substantially maintained at a sustain bias voltage Vz. The sustain bias voltage Vz is lower than the voltage Vs of the sustain signal, and is higher than the ground level voltage GND.

During the sustain period, a sustain signal is alternately supplied to the first electrode and the second electrode. The sustain signal has a voltage magnitude corresponding to the sustain voltage Vs.

As the wall voltage within the discharge cell selected by performing the address discharge is added to the sustain voltage Vs of the sustain signal, every time the sustain signal is supplied, the sustain discharge, i.e., a display discharge occurs between the first electrode and the second electrode.

Figure 14:
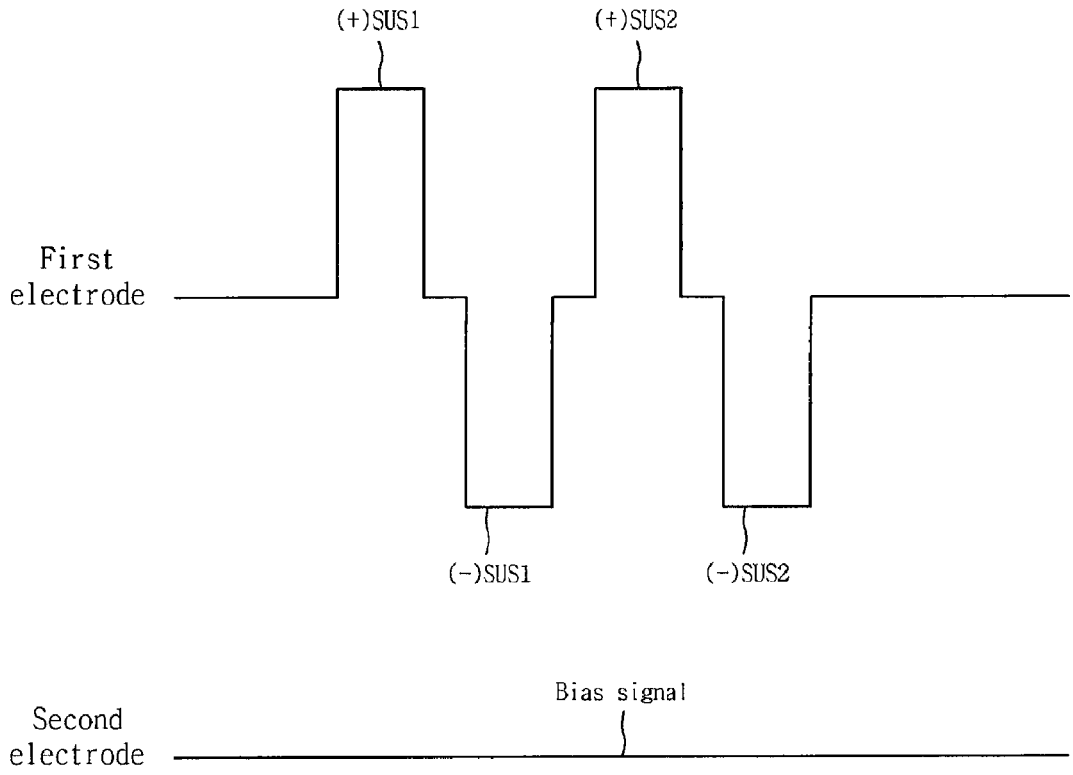
FIG. 14 illustrates another type of a sustain signal.

FIG. 14 illustrates another type of a sustain signal.

Referring to FIG. 14, a sustain signal ((+)SUS1, (+)SUS2) of a positive polarity direction and a sustain signal ((−)SUS1, (−)SUS2) of a negative polarity direction are alternately supplied to either the first electrode or the second electrode, for example, to the first electrode in FIG. 14.

As above, when the sustain signal of the positive polarity direction and the sustain signal of the negative polarity direction are alternately supplied to the first electrode, a bias signal is supplied to the second electrode. The bias signal is constantly maintained at the ground level voltage GND.

As illustrated in FIG. 14, when the sustain signal is supplied to either the first electrode or the second electrode, a single diving board for installing a circuit for supplying the sustain signal to either the first electrode or the second electrode is required. Accordingly, the whole size of a driver for driving the plasma display panel is reduced such that the manufacturing cost is reduced.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display panel, comprising:

a front substrate on which a first electrode and a second electrode are formed in parallel to each other;

a rear substrate on which a third electrode is formed to intersect the first electrode and the second electrode; and a barrier rib, formed between the front and rear substrates, partitioning a discharge cell, wherein at least one of the first electrode or the second electrode is formed in the form of a single layer, at least one of the first electrode or the second electrode includes at least one line portion intersecting the third electrode, and a plurality of projecting portions projecting from at least one line portion, and the shape of at least one of the plurality of projecting portions is different from the shape of the other projecting portions.

2. The plasma display panel of claim 1, further comprising a dielectric layer formed on the front substrate, wherein a color of at least one of the first electrode or the second electrode is darker than a color of the dielectric layer.

3. The plasma display panel of claim 1, further comprising a black layer formed between the front substrate and at least one of the first electrode or the second electrode, wherein a color of the black layer is darker than a color of at least one of the first electrode or the second electrode.

4. The plasma display panel of claim 1, wherein at least one of the plurality of projecting portions has a portion with the curvature.

5. The plasma display panel of claim 1, wherein the plurality of projection portions each include at least one first projection portion projecting toward a first direction, and at least one second projection portion projecting toward a second direction that is opposite to the first direction.

6. The plasma display panel of claim 5, wherein the length of the first projection portion is different from the length of the second projection portion.

7. The plasma display panel of claim 5, wherein the width of the first projection portion is different from the width of the second projection portion.

8. The plasma display panel of claim 1, wherein the number of line portions is plural, and at least one of the first electrode or the second electrode includes a connecting portion connecting two or more line portions of the plurality of line portions.

9. The plasma display panel of claim 8, wherein a portion where the line portion and the connecting portion abut each other has the curvature.

10. The plasma display panel of claim 1, wherein at least one of the plurality of projecting portions overlaps the third electrode.

11. The plasma display panel of claim 1, wherein at least one of the first electrode or the second electrode is an ITO (indium-tin-oxide)-less electrode.

12. A plasma display panel, comprising:

a front substrate on which a first electrode and a second electrode are formed in parallel to each other;

a rear substrate on which a third electrode is formed to intersect the first electrode and the second electrode; and a barrier rib, formed between the front and rear substrates, partitioning a discharge cell, wherein at least one of the first electrode or the second electrode is formed in the form of a single layer, at least one of the first electrode or the second electrode includes at least one line portion intersecting the third electrode, and a plurality of projecting portions projecting from at least one line portion, and the length of at least one of the plurality of projecting portions is different from the length of the other projecting portions.

13. The plasma display panel of claim 12, wherein at least one of the plurality of projecting portions has a portion with the curvature.

14. The plasma display panel of claim 12, wherein the plurality of projection portions each include at least one first projection portion projecting toward a first direction, and at least one second projection portion projecting toward a second direction that is opposite to the first direction.

15. The plasma display panel of claim 12, wherein the number of line portions is plural, and at least one of the first electrode or the second electrode includes a connecting portion connecting two or more line portions of the plurality of line portions.

16. The plasma display panel of claim 12, wherein at least one of the plurality of projecting portions overlaps the third electrode.

17. The plasma display panel of claim 12, wherein at least one of the first electrode or the second electrode is an ITO-less electrode.

18. A plasma display panel, comprising:

a front substrate on which a first electrode and a second electrode are formed in parallel to each other;

a rear substrate on which a third electrode is formed to intersect the first electrode and the second electrode; and a barrier rib, formed between the front and rear substrates, partitioning a discharge cell, wherein at least one of the first electrode or the second electrode is formed in the form of a single layer, at least one of the first electrode or the second electrode includes at least one line portion intersecting the third electrode, and a plurality of projecting portions projecting from at least one line portion, the shape of at least one of the plurality of projecting portions is different from the shape of the other projecting portions, and an aperture ratio in an active area ranges from 25% to 45%.

19. The plasma display panel of claim 18, wherein at least one of the plurality of projecting portions has a portion with the curvature.

20. The plasma display panel of claim 18, wherein the plurality of projection portions each include at least one first projection portion projecting toward a first direction, and at least one second projection portion projecting toward a second direction that is opposite to the first direction.

* * * * *